US007866494B1

(12) United States Patent
Emile

(10) Patent No.: US 7,866,494 B1
(45) Date of Patent: Jan. 11, 2011

(54) CLOSET

(76) Inventor: Jean Emile, 8404 Flint Hill Dr., Richmond, VA (US) 23227

( * ) Notice: Subject to any disclaimer, the term of this patent is extended or adjusted under 35 U.S.C. 154(b) by 21 days.

(21) Appl. No.: 12/459,817

(22) Filed: Jul. 8, 2009

Related U.S. Application Data

(60) Provisional application No. 61/134,852, filed on Jul. 14, 2008.

(51) Int. Cl.
*A47B 47/00* (2006.01)

(52) U.S. Cl. ..... 211/196; 211/85.3; 211/182; 248/159; 248/166; 248/910

(58) Field of Classification Search ..... 211/85.3, 211/189, 182, 195, 196, 205, 107, 133.4; 248/159, 166, 910; 108/149, 150, 160, 158.11
See application file for complete search history.

(56) References Cited

U.S. PATENT DOCUMENTS

| | | | | | |
|---|---|---|---|---|---|
| 725,458 | A * | 4/1903 | Levy | ..... | 248/158 |
| 3,671,738 | A * | 6/1972 | Beachley | ..... | 362/431 |
| 4,421,260 | A | 12/1983 | DeVore | | |
| 4,463,883 | A | 8/1984 | DeVore | | |
| 4,890,749 | A * | 1/1990 | Walter | ..... | 211/189 |
| 5,016,848 | A * | 5/1991 | Metz | ..... | 248/176.1 |
| 5,022,722 | A | 6/1991 | Wallin | | |
| 5,129,491 | A | 7/1992 | Saidman | | |
| 6,003,696 | A * | 12/1999 | Hsiu-Chen | ..... | 211/182 |
| 6,959,824 | B1 | 11/2005 | Alperson | | |
| 7,216,839 | B2 * | 5/2007 | Xiaoqiu et al. | ..... | 248/346.2 |

* cited by examiner

*Primary Examiner*—Korie Chan
(74) *Attorney, Agent, or Firm*—Rajendra P. Raval

(57) ABSTRACT

A portable and multi-purpose T-shaped closet and coat rack includes a foldable flat base made of four equal plates which are joined together by hinges beneath the plates. A removable hollow cylinder which is a stabilizer/coin holder/piggy bank is mounted over the base. The stabilizer has a mass of at least three kilograms when filled with coins, sand, marbles or like materials. A single post directed vertically and divided into three separate sections allowing different height adjustments is mounted on the base. Two of the segments of the post are equipped with a motion control apparatus to neutralize to the arms' motions. A special bi-functional cap completes the erecting of the post and comprises of two opposite threaded extensions which are designed to receive the arms of the unit. Two removable and identical, trombone-shaped arms mounted on either sides of the cap constitute the racks for the hanging of garments. Two security extensions secure the bases of the arms with the post on either side. Four freely rotating cups located at the top of the base are used to secure the stabilizer and the base into one compact unit. Two freely rotating cups attach the arms to the cap of the unit.

16 Claims, 10 Drawing Sheets

CLOSET

CROSS-REFERENCE TO RELATED APPLICATION

This application is entitled to the benefit of Provisional Patent Application Ser. No. 61/134,852 filed 2008 Jul. 14 by the same inventor.

FEDERALLY SPONSORED RESEARCH

Not Applicable.

SEQUENCE LISTING

Not Applicable.

BACKGROUND

1. Field

The present invention relates in general to in-home or domestic portable closets and coat racks with commercial adaptation and marketability for offices and retail use as well. Its purpose is to provide additional, temporary and permanent ways to hang garments and other types of clothing accessories.

2. Prior Art

There is a wide variety of portable closets and coat racks currently available in the marketplace. In fact, there are numerous T-shaped portable closets and coat racks that are close in appearance to this present invention. However, their design and construction do not address most consumers' sought after criteria of simplicity, stability, durability, versatility and estheticism. Some of them even neglect the paramount criteria of safety as they can easily break down or topple over. The assembly of some current portable closet and coat rack models can be sometimes cumbersome and, with many of them, the consumer has to have extra mechanical accessories or some specially designed tool in order to erect and disassemble the unit. Those accessories and tools sometimes come in the box but, unfortunately, too often consumers have to run to the closest hardware store to buy them when they are missing. This may be repeated several times if this small tool is lost or misplaced. Also, the models currently available are often designed for child use strictly or exclusively for adults. A single unit constructed to suit both child and adult use with consideration for height and age variations is a rare commodity if it exists at all.

The U.S. Pat. No. 5,022,722 by Maynard A. Wallin describes a portable closet to fit behind a wall or in a recreational vehicle to store and hang clothes. This closet has arms as racks in the horizontal position attached to the closet to put shirt and trouser hangers. The shirt rack has large equally spaced shirt hanger hooks screwed in along its length to hang shirt hangers.

Furthermore, U.S. Pat. No. 4,421,260 by Robert E. DeVore also describes a portable clothes closet to be attached to a vehicle. This invention has a base which provides a surface to support the closet. In addition, it has a frame with cross bar to hang clothes. The frame is attached to the base.

Moreover, U.S. Pat. No. 5,129,491 by Elizabeth A. Seidman describes a portable closet for storing, transporting, and displaying clothes. The closet comprises the hanger rods which extend across the left and right portions of the closet. The hanger rod is located near the top of the rear portion of the box.

In U.S. Pat. No. 4,463,883 issued to Robert E. DeVore, a portable clothes closet bracket to be attached to a vehicle is disclosed. This closet also has a base which provides support to the storage device. The frame is attached to the base.

In U.S. Pat. No. 6,959,824 B1 issued to Joel Alperson, a retail display rack is described having a base member, a tubular housing member for receiving a pair of arms. The simple, easily adjustable and stable display rack is used for holding garments.

The object of this invention is to provide a simple, reliable, stable, durable, versatile, safe, and user-friendly portable closet and coat rack to hang and store clothes and accessories. It creates additional rack space without being at odds with the decor. It is easily and safely adjusted at selective heights suitable for adult and children. It requires no assembly of tools or cumbersome mechanical accessories to erect or disassemble; thereby making its transportation and storage very easy.

This present device is a simplified portable closet and coat rack (that comes with a coin insert located in the area of the base called the stabilizer which also functions as a coin holder/piggy bank. Unlike many products in its category, this multi-purpose portable closet and coat rack does not require cumbersome mechanical accessories or assembly tool. Versatility is among its many characteristics allowing the unit to be adjusted safely and easily at selectable heights making it suitable for both child and adult use. The conception and design of this product is to provide user-friendly, more aesthetic and more reliable portable closet or clothing rack. The criteria of stability, durability, versatility, simplicity, estheticism and safety are the main items of this new portable closet and coat rack.

Therefore, the primary focus was to make a product that is stable and safe but simple, easy to handle and that can be used by a larger population of consumers. This product is conformable to both domestic and commercial consumers and adaptable to both child and adult use. This new generation of portable closet and coat rack is now invented for many to enjoy having in their homes or place of business. This esthetically well designed unit creates additional closet and coat rack space without being at odds with the décor. This product is assembled manually and easily by following only a few simple steps. The process takes only a fraction of the time required by the other ordinary portable closets or coat racks. The closet can also be taken apart and stored in a fraction of the time required by the currently available models. Yet the criteria of safety, stability, estheticism, durability, and versatility are not compromised due to the unit's innovative design. This invention is also unique when considering the fact that absolutely no tools are required to erect or disassemble the unit as well as its potential use as a coin holder/Piggy Bank where parents can teach savings to children or use for themselves to store away petty cash. Transporting this light weight product is also easy as it can fit in a bag and carried in one arm with not much effort.

The four plates of the flat base, the folding capability of the base, the four screwing cups, and retainers of the base, the petal shape of the plates, the two screwing cups of the arm, the specially designed cylinder-shaped stabilizer, the savings and storage features of the stabilizer, the four threaded legs of the stabilizer, the specially designed mounting post sections, the bi-functional mounting cap, the specially designed trombone shaped arms, the no tool concept and design of the entire unit convey to this invention its flair and its originality.

SUMMARY

The present invention is a portable and multi-purpose closet which has a base with more than two plates and cups. The plates are joined at fabrication by hinging them together so that they may fold one on top of the other more than one reason.

The base may be folded for storage and expanded flat on the floor for mounting when the closet is being assembled. A stabilizer is placed on the base by screwing it to the cups of the base. A post having many sections for adjusting its height and a motion control apparatus is put on the post. A bi-functional cap with two oppositely threaded extensions is mounted on the post. Also, two arms or more having bases and cups are placed on the post. The cups of the arms are screwed onto either side of the threaded cap. The bases of the arms are locked in with the motion control apparatus on the post. To assemble the closet, the stabilizer is secured on the base, the post is mounted on the stabilizer, the cap is placed on the section of the post equipped with the motion control apparatus, and the arms are fixed on either side of the cap.

DRAWINGS

Figures

FIG. 1 is a front view of the assembled portable closet and coat rack that includes the base, the stabilizer, the three main sections, the cap and the right and left arms. From one arm to the next, the two arms are approximately 4 feet in length. The height of the unit is approximately 5.4 feet when using the main sections.

Figure 3:
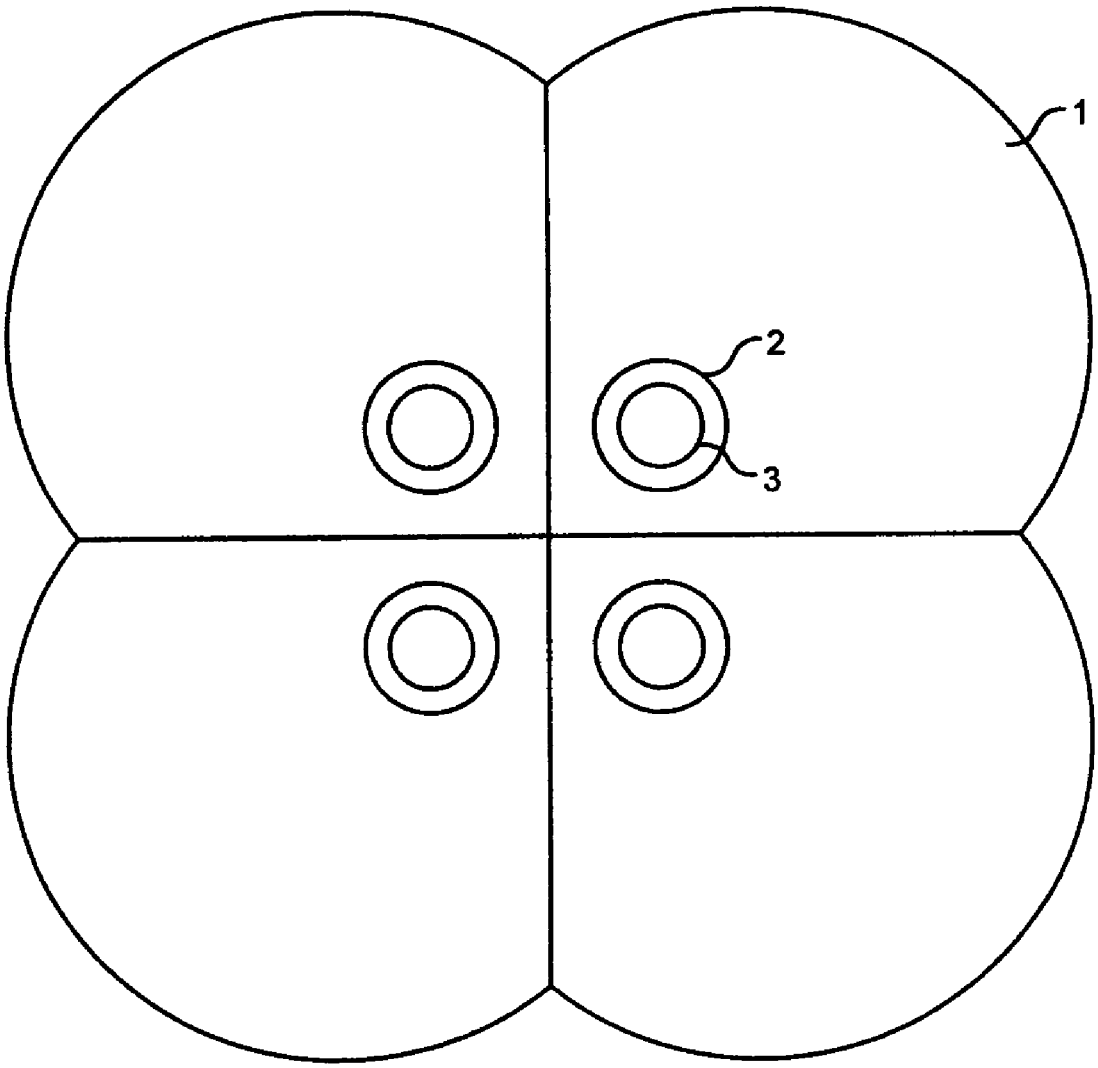
FIG. 3 is a downward view of the base laid flat on the ground.
Figure 3A:
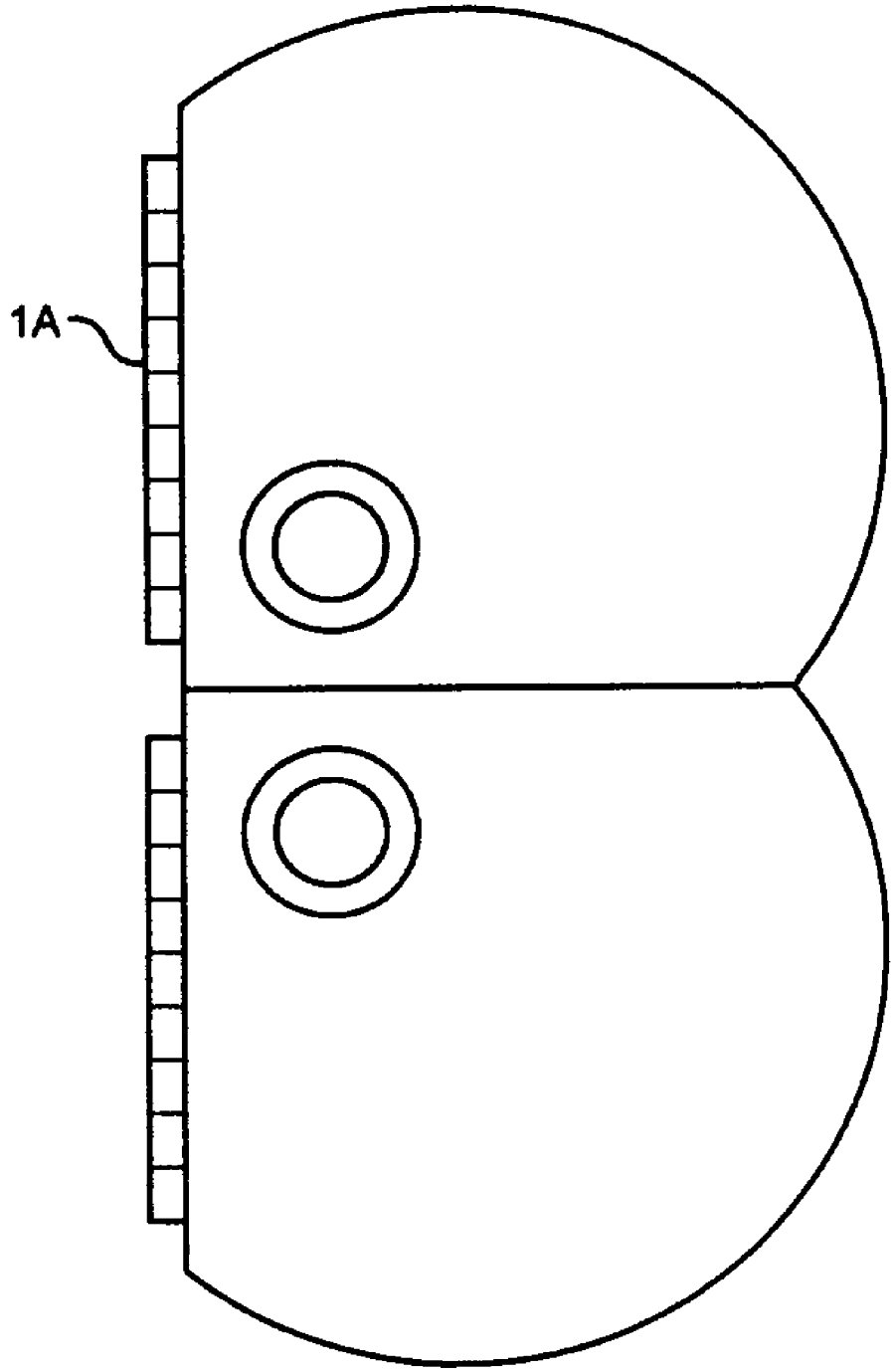

FIG. 3*a* is a downward view of the base folded in two parts.

Figure 4:
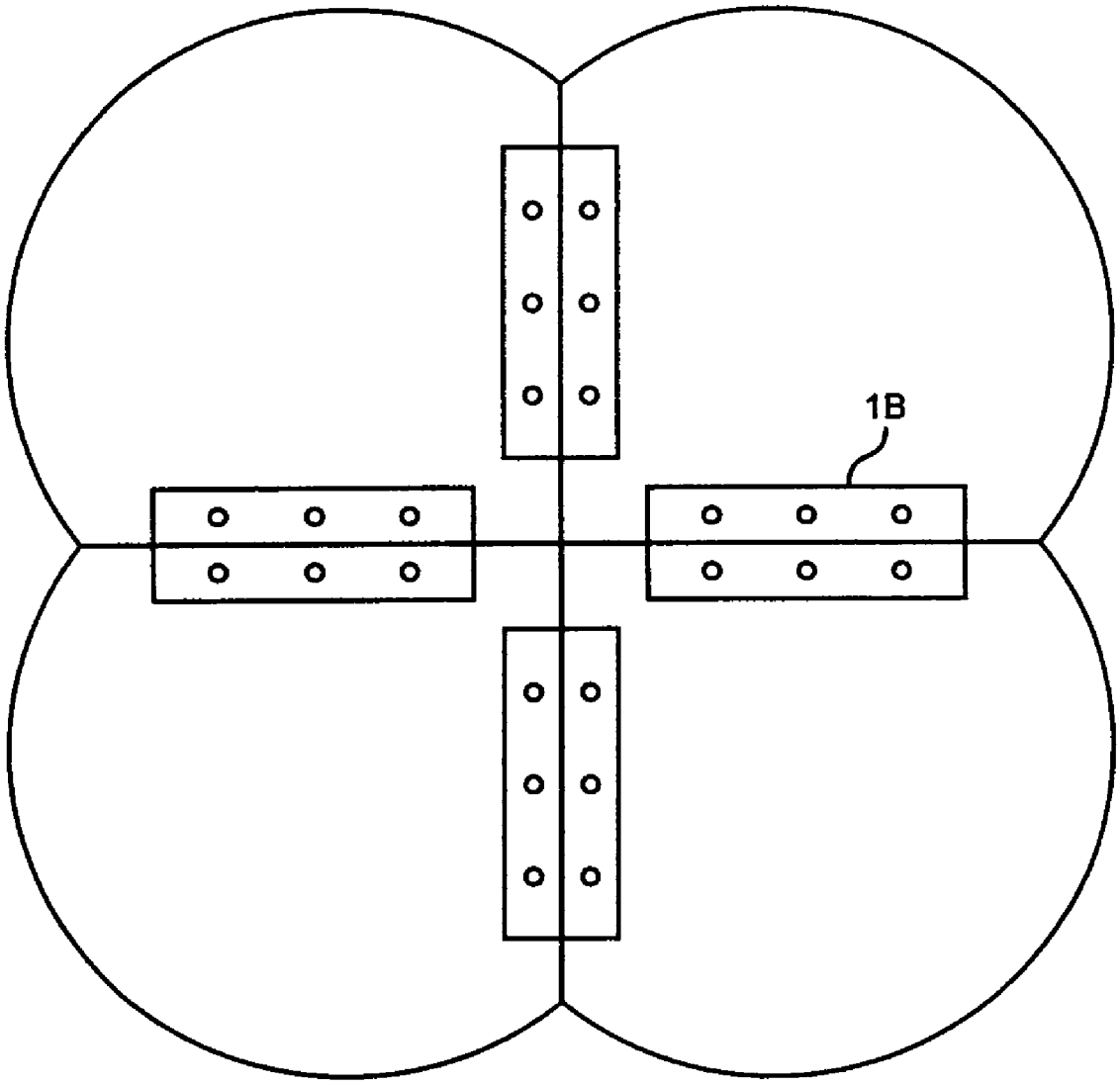

FIG. 4 is a downward view of the base laid flat on the ground upside down.

Figure 5:
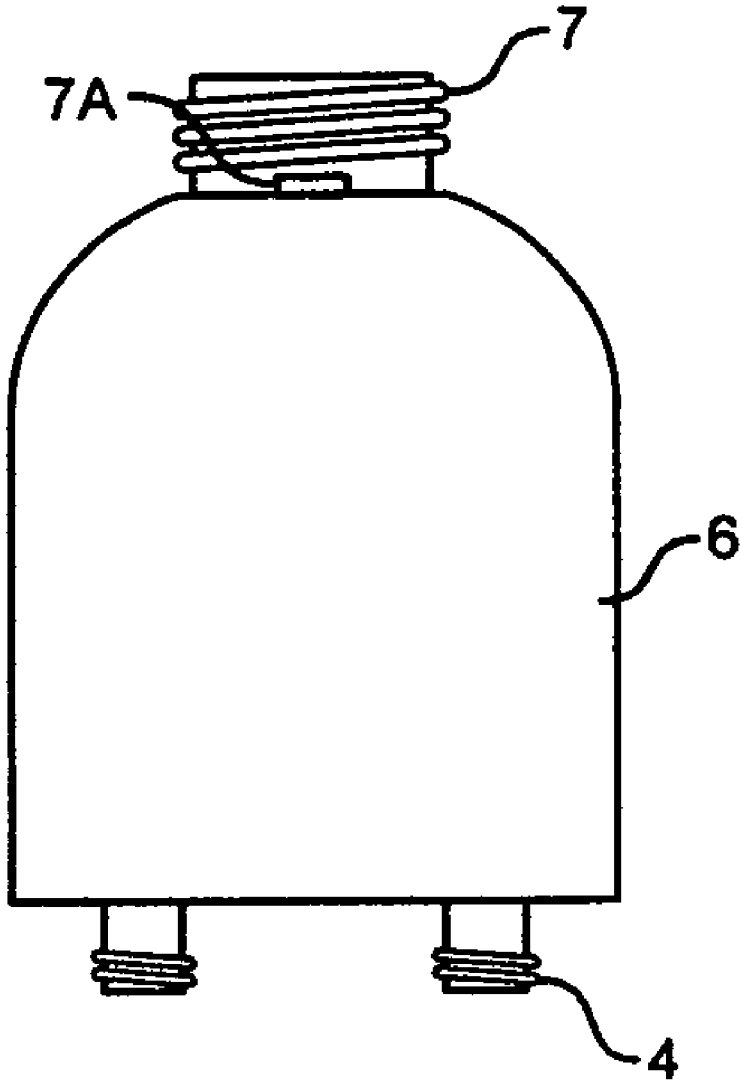

FIG. 5 is a front view of the stabilizer showing the coin insert.

Figure 6:
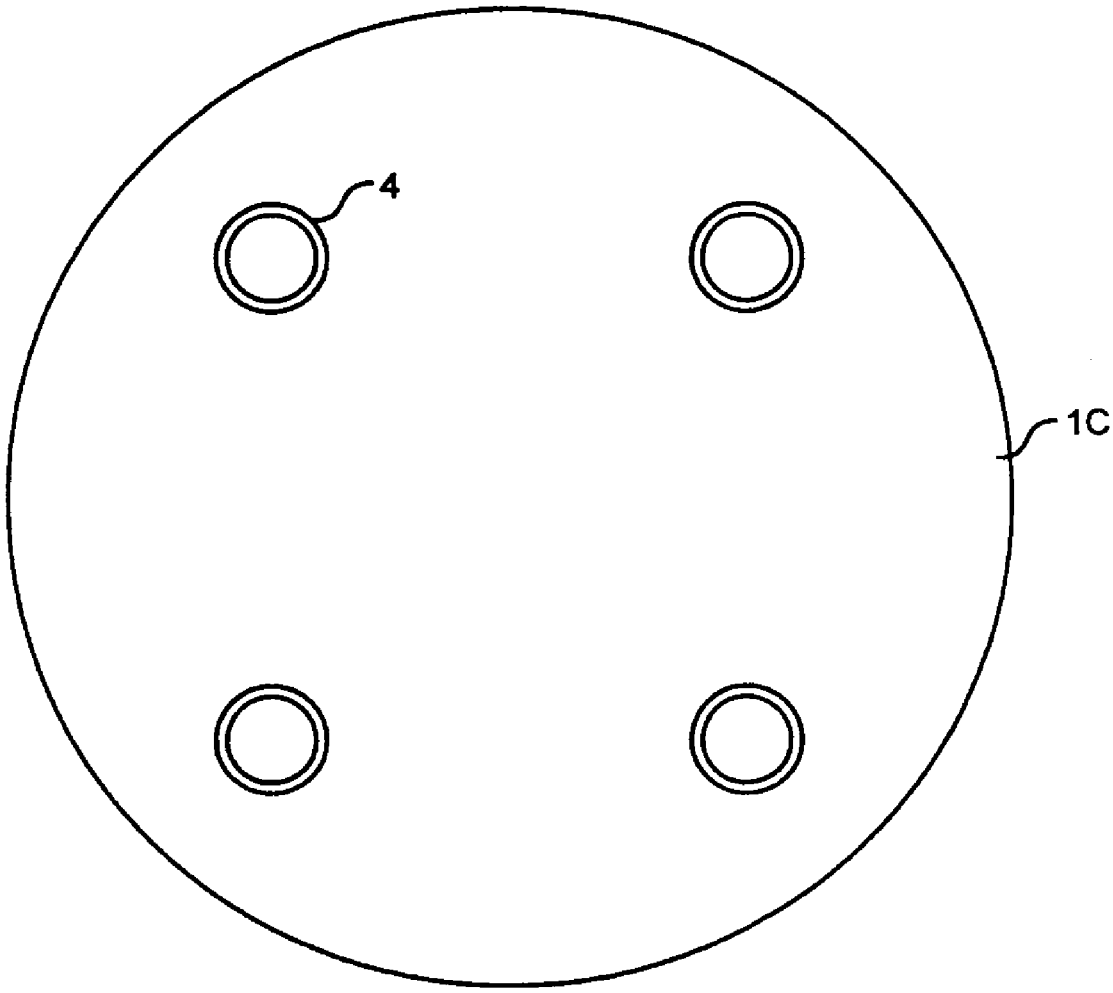

FIG. 6 is a downward view of the stabilizer positioned upside down.

Figure 7:
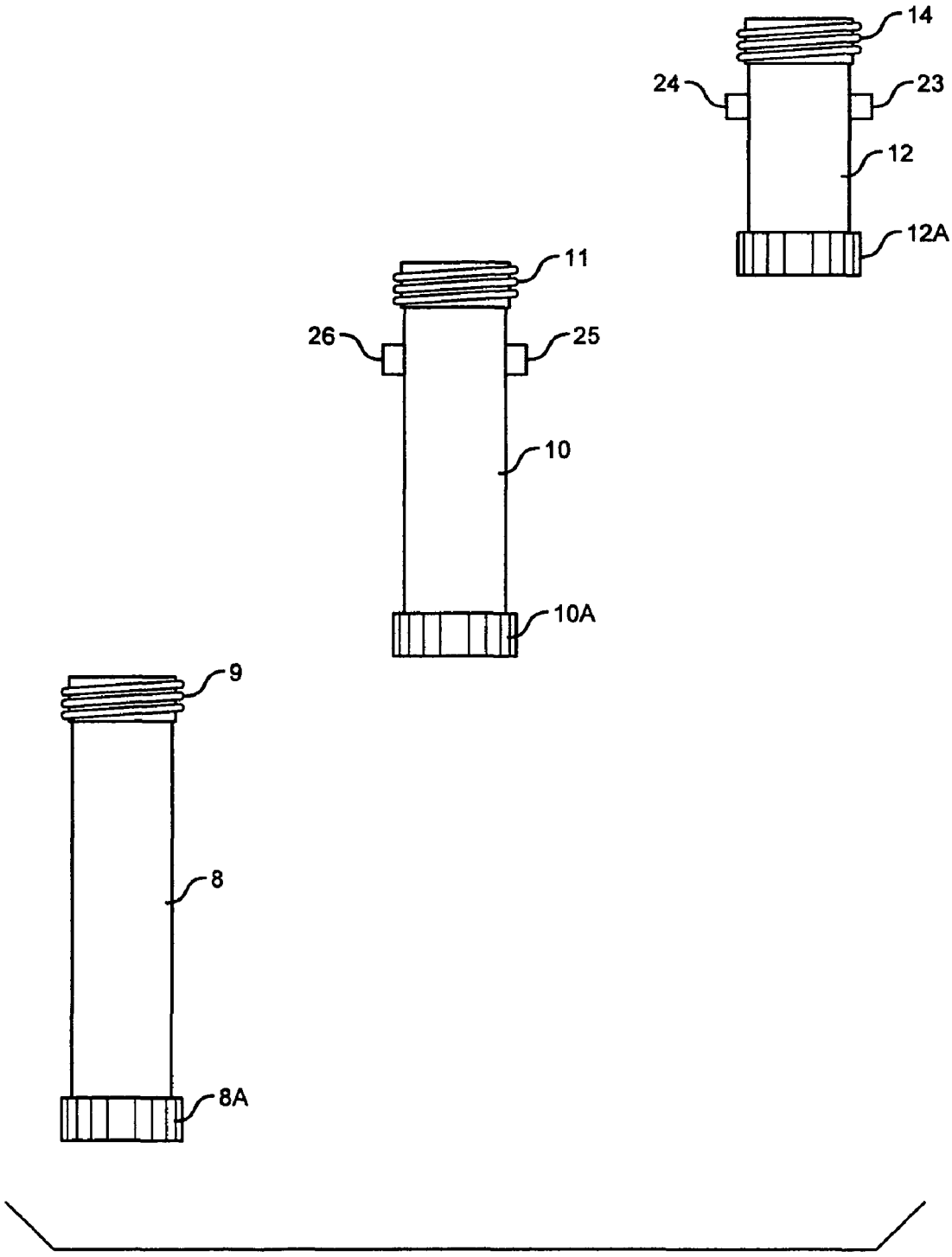

FIG. 7 is a front view of the three main segments of the support system.

Figure 8:
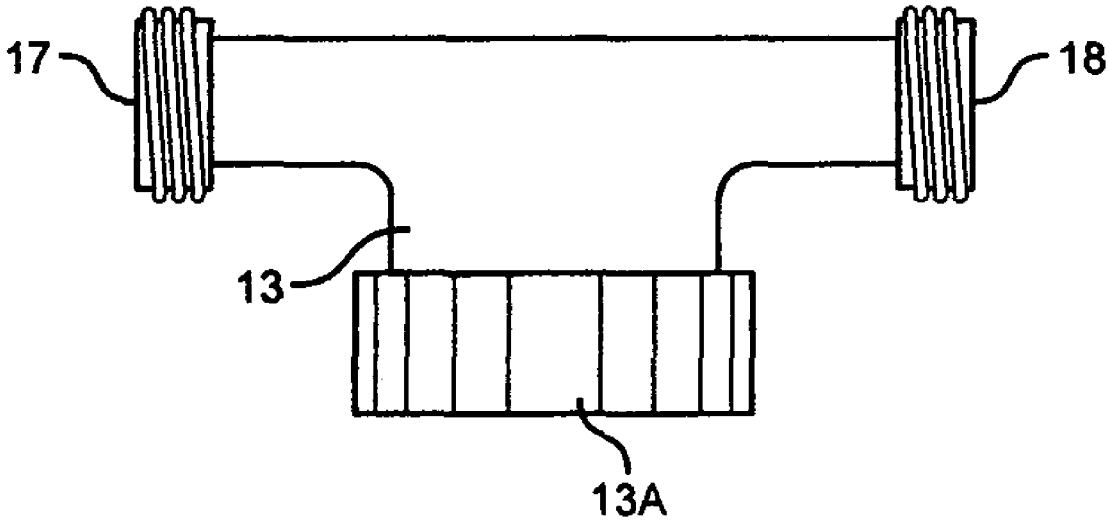

FIG. 8 is front view of the cap looked at separately.

Figure 9:
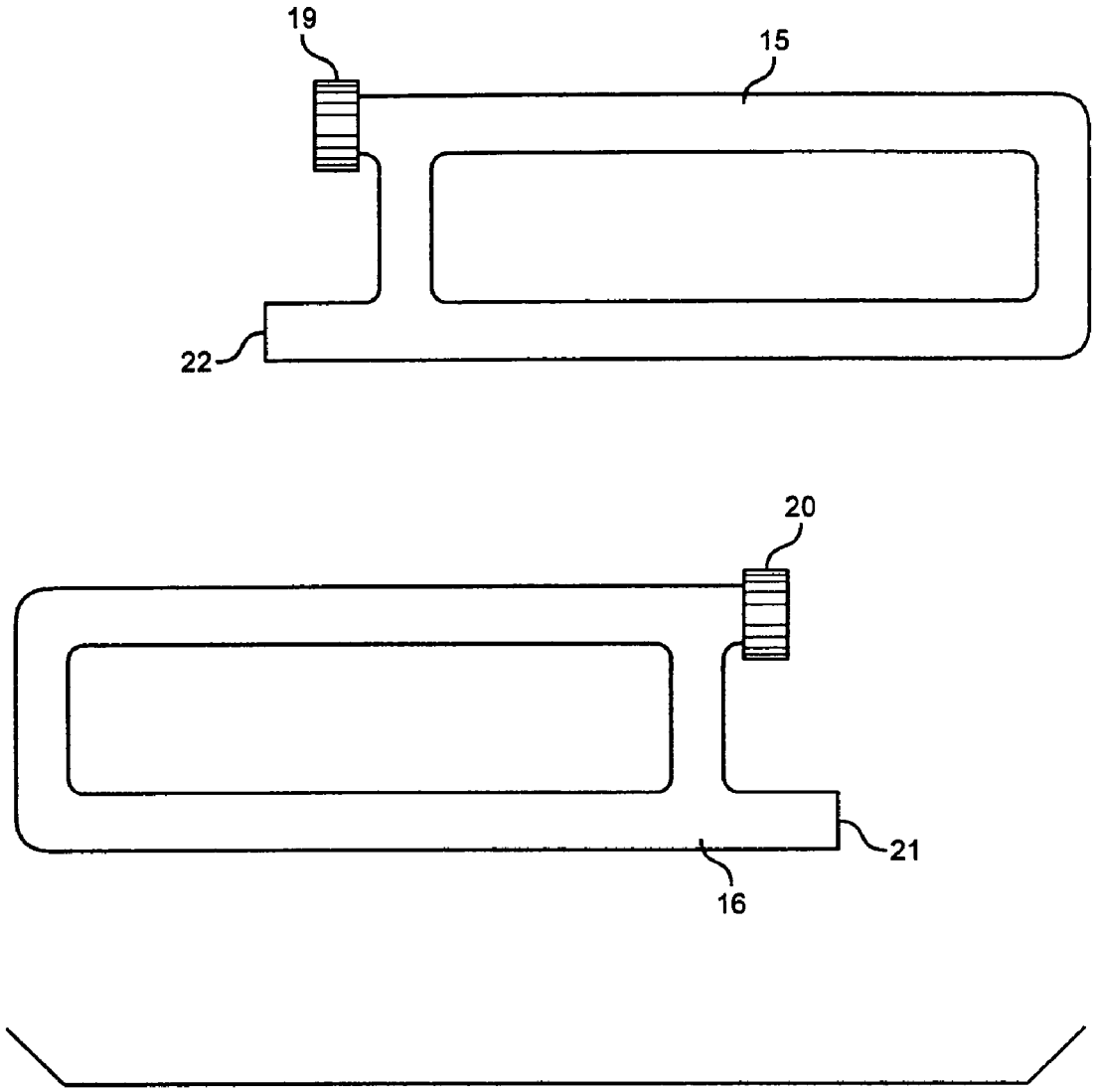

FIG. 9 is a front view of the arms looked at separately.

DRAWINGS

Reference Numerals

1. Plates
1*a*. Hinges with plates folded
1*b*. Hinges with plates open and upside down
1*c*. Bottom of the stabilizer
2. Cups
3. Fixed retainer
4 Threaded legs
5. Screw
6. Stabilizer
7. Threaded extension of the stabilizer
7*a*. The coin insert
8. First section of the post
8*a*. Inner-threaded end of the first section
9. Threaded extension of the first section of the post
10. Second section of the post
10*a*. Inner-threaded end of second section
11. Threaded extension of the second section of the post
12. Third section of the post
12*a*. Inner-threaded end of the third section
13. Cap
13*a*. Inner-threaded end of the cap
14. Threaded extensions of the third section of the post
15, 16 Arms (left, right)
17, 18 Threaded extensions of the cap (right, left)
19, 20 Rotating cups of the cap (left, right)
21, 22 Bases of the arms (right, left)
23, 24, 25, 26 Motion control devices

DETAILED DESCRIPTION

The T-shaped portable closet and coat rack includes a flat base, a bi-functional cylinder called stabilizer to be mounted in the center of the flat base and ended with a narrow vertical extension, a single post or support system divided into three segments, a cap and two opposite and identical arms designed to receive garments and other clothing accessories. This free standing closet and coat rack responds to many deficiencies encountered in prior arts of this sort by its design and construction. The many features, versatility and design will appeal to both domestic and commercial consumer use.

The Base

The base consists of four identical and foldable plates of approximately ⅓ of an inch in thickness each, joined together and over which the unit is mounted. The base covers an area of approximately 2.5×2.5 feet and is rested fiat on the ground. The base can be folded into two equal sections to render its storage easy and practical. Installed around the center of the base, are four freely rotating cups ready to receive and secure the stabilizer via its four threaded legs or connectors.

The stabilizer

This device is designed to hold down the base by applying extra downward weight towards its center. This extra weight helps neutralize accidental weight variations from the top of the unit with the removal or addition of garments. The stabilizer renders the system virtually impossible to topple over unless subjected to some sort of major external force. The stabilizer is secured by simply joining the four threaded legs located underneath the cylinder with cups of the plates. Once installed, the stabilizer may be filled with coins, marbles or other substance which are intended to provide the extra weight. The stabilizer is not designed to hold water. The stabilizer provides an excellent way for users of all ages to start a coins savings account/Piggy Bank. The stabilizer is part of the base and therefore, accessible by the whole household from the very young to middle aged and adults. This component is a cylindrical container directed vertically with a flat bottom and ended by a narrow treaded extension. At the start of the threaded extension, an insert is made horizontally to allow the insertion of coins or currencies into the cylinder/stabilizer which is used as a coin holder or piggy bank. This extension marks the beginning of vertical support system.

The Vertical Support System

After properly positioning and filling up the stabilizer, the next step is to erect the post or support system of the portable closet and coat rack. This is achieved simply by screwing the different segments of the post together. The user has the choice of constructing a desired height by using any combination of the three segments provided. This versatility makes the unit suitable to both adult and child use. The two last segments comprise a motion control apparatus in the form of a retractable pin that locks in the arms of the unit in a fixed position.

The Cap

The cap completes the assembling of the vertical support system and also provides two Threaded extensions, left and right, with which two cups of the arms are screwed together.

The Arms

Exactly identical left and right arms are screwed onto the cap extensions and constitute the final step of putting the unit together. The installer proceeds just by securing the freely rotating cups located at the end of each arms onto the caps' extensions. To finalize the process of securing the arms, the installer locks the bases of the arms with the motion control pins located on either side of the post.

Figure 1:
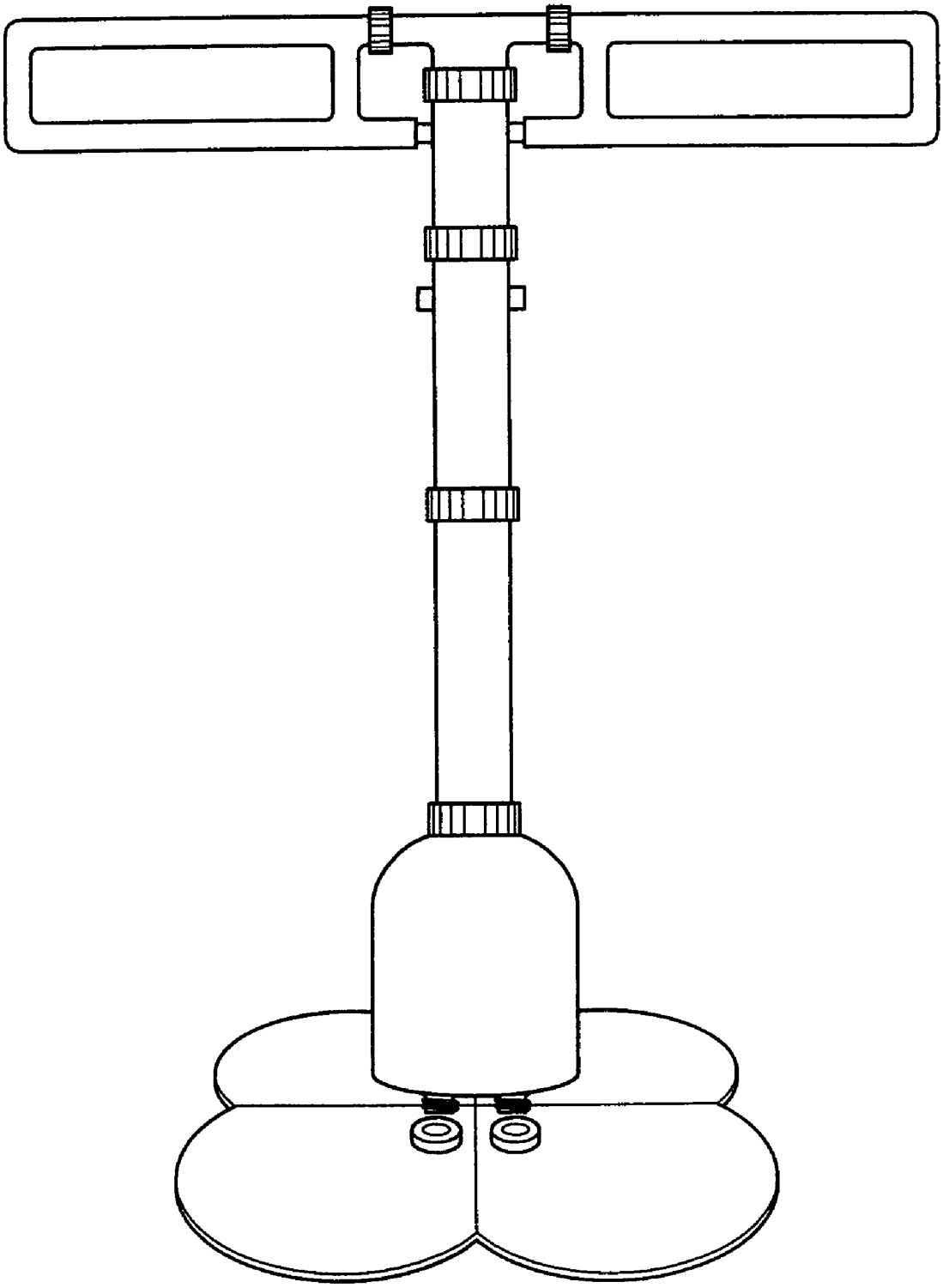

Referring now to the drawing in FIG. 1, a portable multipurpose closet and coat rack, is designed based on the criteria of strength, stability, durability, simplicity, estheticism, versatility and convenience. The present invention is suited for in home and retail use and is mainly made for the hanging of garments on a permanent or temporary basis.

Figure 2:
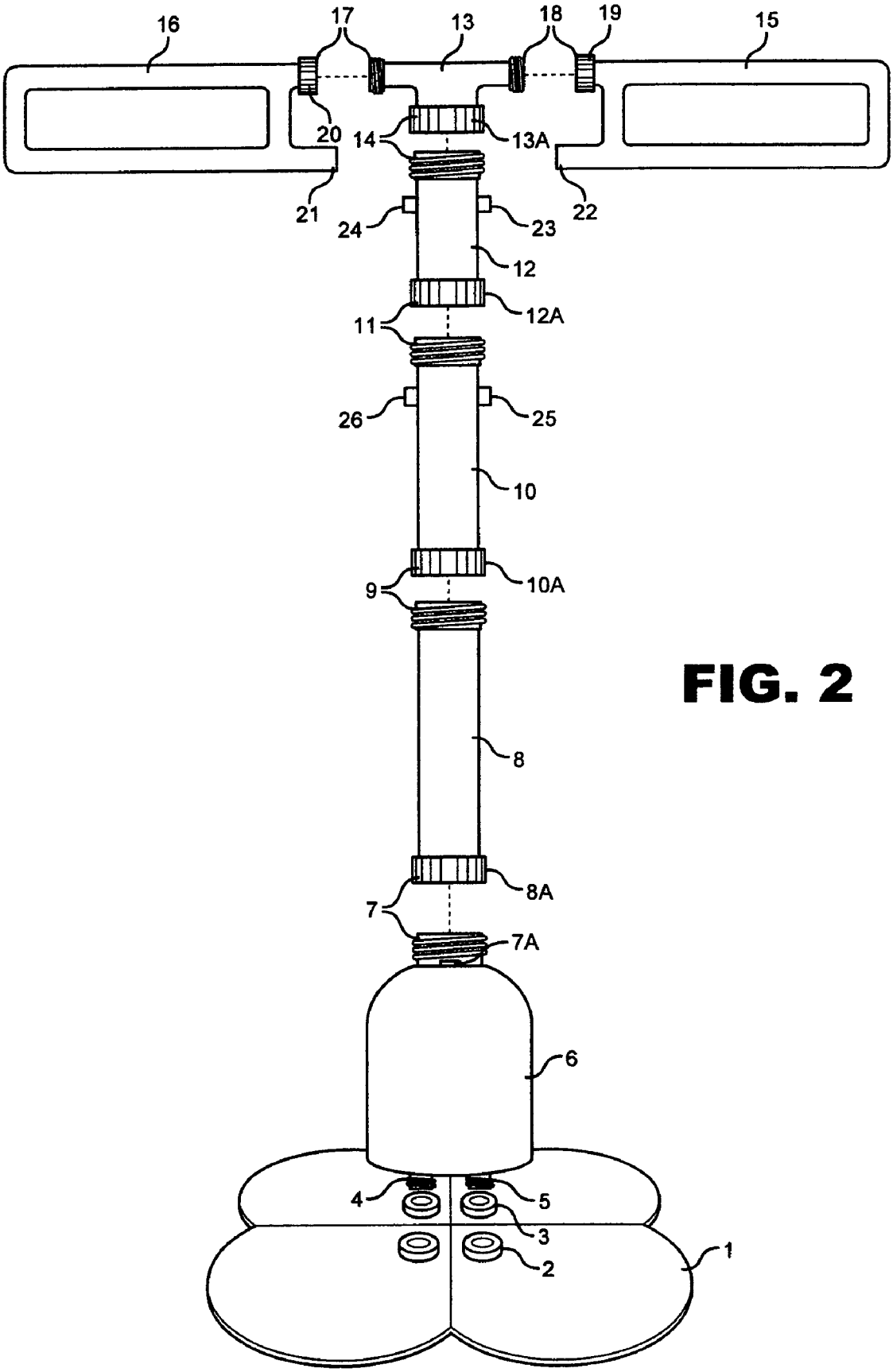
FIG. 2 is front view perspective of the portable closet and coat rack displaying how to connect the different parts by screwing them together.

Referring now to FIG. 2 which displays the process of mounting the unit, the plates 1 constitute the legs of the support system. They are laid flat on the ground and around the center of base are four cups 2 that rotate freely each around a fixed retainer 3 that keeps them bound to the plates. The threaded legs 4 of the stabilizer 6 are rested on the retainers then secured with the cups 5 to become the compact base component support system. The first section 8 of the post is secured by screwing its inner-threaded end 8*a* with the threaded extension 7 of the stabilizer, the second section 10 is joined by screwing its inner-threaded end 10*a* with the top threaded portion 9 of the first section and the third section 12 is also joined by screwing its inner-threaded end 12*a* with the top threaded portion 11 of the second section.

At choice, the owner may only use two sections depending on the desired height. The cap 13 is added by screwing its inner-threaded end 13*a* with the superior threaded portion of the last section 10 or 12 of the support system. The arms, right 15 and left 16, are joined with the cap by screwing their rotating cups 19, 20 into the cap's threaded extensions 17, 18. The bases of the arms 21, 22 are secured with the post via the motion control devices or pins 23, 24, 25, 26 that prevent the arms from swinging back and forth.

Referring now to FIG. 3, it shows the four plates 1, the freely rotating cups 2, and the retainers 3 that hold the cups to the plates.

Referring now to FIG. 3*a*, it shows the base equally folded in two exposing the hinges 1 that hold the plates together.

Referring now to FIG. 4, showing the reverse side of the base and how the four hinges 1*b* attach the four plates together.

Referring the FIG. 5 showing a front view of the stabilizer and pointing out the body of the cylinder 6, the coin slot or insert 7*a*, the threaded legs 4 that anchor into the freely rotating cups of the base and the narrow threaded extension 7 pointing vertically to initialize the erection of the post Referring now to FIG. 6, showing a direct downward view of the bottom 1*c* of the stabilizer where the threaded legs 4 are positioned.

Referring now to FIG. 7, showing a front view of the three sections 8, 10, 12 of the post and the last two sections equipped with the motion control apparatus 23, 24, 25, 26 which helps prevent the swinging of the arms of the system, the inner-threaded ends 8*a*, 10*a*, 12*a* and the outer threaded ends 9, 11, 14 of the sections respectively.

Referring now to FIG. 8 showing the cap 13 that completes the mounting of the post and its left and right extensions 17, 18 unto which the arms are secured and the inner-threaded end of the cap.

Referring now to FIG. 9, which shows the arms 15, 16 and the rotating cups 19, 20 that secure them with the cap's extensions as well as the bases 21, 22 of the arms that will be secured with the motion control system which is made of the same material as the closet.

Operation

The base consists of four identical plates joined together over which the unit is mounted. Installed around the center of the base are four specially designed cups ready to receive the unit's stabilizer. The stabilizer is secured by anchoring the four threaded legs located underneath the bottom with the cups of the base. Once the stabilizer is installed, it may be filled with sand, coins, or marbles to apply more weight in the center of the unit rendering it more stable. After positioning and filling the stabilizer, the segments of the post are screwed into the stabilizer. The cap covers the top of the post and is crafted to receive the right and the left arms of the closet. Exactly identical left and right arms are screwed into the cap and that constitute the final steps of putting the unit together. The closet is made of aluminum, plastic, wood, metal, or like materials.

Advantages

The main advantage of this invention is that it provides a simple, reliable, stable, durable, versatile, safe, and user-friendly portable closet to store and hang clothes and accessories. In addition, it creates additional rack space without being at odd with the decoration. Furthermore, it is easily and safely adjusted at selective heights suitable for adult and children. Also, it requires no assembly of tools or cumbersome mechanical accessories to erect or assemble thereby making its transportation and storage not cumbersome.

CONCLUSION, RAMIFICATIONS, AND SCOPE

Accordingly, the reader will see that the portable closet of this invention can be used to hang and store clothes and accessories. The assemblies of the closets in the prior art are cumbersome to erect and disassemble while the present invention is safe, simple, stable, and user-friendly. Its height can be adjusted making it suitable to use by adults and children. Furthermore, the portable closet has the additional advantages in that

- It permits to save additional space without being at odd with decoration.
- It permits either tall or short persons to use it without annoying inconveniences.
- It permits to use it anywhere required and desired without being permanently attached to the wall or at particular point.
- It permits to preserve estheticism of the location.
- It is very versatile to place anywhere needed to use it.
- Its assembly is very simple to for the user to utilize it as often as needed.
- It is very durable to use for many years since it does not break down.
- It is very safe to use since it does not topple over and cause injury to user.

It will thus be appreciated that those skilled in the art will be able to devise numerous alternative arrangements that, while not shown or described herein, embody the principles of the invention and thus are within its spirit and scope. Thus the scope of the invention should be determined by the appended claims and their legal equivalents, rather than by the examples given.

What is claimed is:

1. A portable and multi-purpose closet and garment rack, comprising;

a) A base having a plurality of feet with threaded cups extending upwardly from the plurality of feet, at least two of said feet joined together by hinges; wherein the plurality of feet are coplanar defining a flat surface for engaging a ground surface b) A stabilizer having a plurality of bolts and mounted onto said base by screwing said bolts to said cups;

c) A post having a plurality of sections and mounted onto said stabilizer;

d) A cap having at least two oppositely positioned extensions and mounted onto said post and e) A plurality of arms mounted onto said extensions of said cap.

2. A portable and multi-purpose closet and garment rack in claim 1, wherein said stabilizer has a mass of at least three kilogram.

3. A portable and multi-purpose closet and garment rack as described in claim 1, wherein said stabilizer is hollow and has an opening for depositing inside said stabilizer quantities of sand, gravel, coins, or similar dense materials, sufficient to increase the mass of said stabilizer to at least three kilograms.

4. A portable and multi-purpose closet and garment rack as described in claim 1, wherein a) At least one section of said post has two or more exterior surface protrusions that extend perpendicular to said post; and b) Said arms are trombone-shaped and have one end that slides onto said protrusion and forms a rigid connection to said post.

5. A portable and multi-purpose closet and garment rack as described in claim 1, wherein a) Said post is mounted onto said stabilizer by means of threaded connectors;

b) Said sections of said post are joined together by means of threaded connectors;

c) Said cap is mounted onto said post by means of threaded connectors; and d) Said arms are mounted to said cap by means of threaded connectors.

6. A portable and multi-purpose closet and garment rack as described in claim 1, wherein said feet for said base are plate-shaped.

7. A portable and multi-purpose closet and garment rack as described in claim 1, wherein said feet of said base are tubular and petal-shaped.

8. A portable and multi-purpose closet and garment rack, comprising:

a) A base having a plurality of feet with threaded cups, at least two of said feet joined together by hinges;

b) A stabilizer having a hollow interior and an opening for depositing inside said stabilizer quantities of sand, gravel, coins, or similar dense materials, and having a plurality of bolts that securely attach said stabilizer to said base by means of said threaded cups;

c) A post having a plurality of sections joined together by means of threaded connectors and mounted onto said stabilizer by means of threaded connectors;

d) A cap having at least two oppositely positioned extensions and mounted onto said post by means of threaded connectors; and e) A plurality of arms mounted onto said extensions of said cap by means of threaded connectors.

9. A portable and multi-purpose closet and garment rack as described in claim 8, wherein a) At least one section of said post has two or more exterior surface protrusions that extend perpendicular to said post; and b) Said arms are trombone-shaped and have one end that slides onto said protrusion and forms a rigid connection to said post.

10. A portable and multi-purpose closet and garment rack as described in claim 8, wherein said feet for said base are plate-shaped.

11. A portable and multi-purpose closet and coat rack as described in claim 8, wherein said feet of said base are tubular and petal-shaped.

12. A closet of claim 8, wherein said base has four identical plates.

13. A closet of claim 8, wherein said plates are approximately ⅓ of an inch in thickness.

14. A closet of claim 8, wherein said base covers an area of 2.5×2.5 feet.

15. A closet of claim 8, wherein four serially designed cups installed around under the center of the base ready to receive the stabilizer.

16. A method of assembling a portable closet and garment rack comprising the steps of:

a) placing the plurality of hingedly connected base plates having threaded cups extending upwardly therefrom flat on the ground;

b) attaching a stabilizer to the base plates by connecting the threaded cups and threaded legs which extend from the stabilizer;

c) mounting a post having a plurality of threadably connected sections on the stabilizer; wherein at least one section of the plurality of sections of the post has motion control devices extending therefrom;

d) connecting a cap having two opposite outward extensions on top of the post;

e) attaching two arms respectively to the opposite extensions of the cap and to the motion control devices to prevent the arms from swinging relative to the post, whereby clothes can be hung on the arms.

* * * * *